US010933271B2

(12) United States Patent
Pace

(10) Patent No.: US 10,933,271 B2
(45) Date of Patent: Mar. 2, 2021

(54) PORTABLE AND ADJUSTABLY WEIGHTED CONTAINERS OF LIQUID FOR FITNESS TRAINING

(71) Applicant: Tony D Pace, Hampton, GA (US)

(72) Inventor: Tony D Pace, Hampton, GA (US)

( * ) Notice: Subject to any disclaimer, the term of this patent is extended or adjusted under 35 U.S.C. 154(b) by 49 days.

(21) Appl. No.: 16/176,803

(22) Filed: Oct. 31, 2018

(65) Prior Publication Data

US 2020/0129801 A1 Apr. 30, 2020

(51) Int. Cl.
*A63B 21/06* (2006.01)
*A63B 21/00* (2006.01)

(52) U.S. Cl.
CPC ..... *A63B 21/0602* (2013.01); *A63B 21/4035* (2015.10); *A63B 21/4043* (2015.10); *A63B 2225/09* (2013.01)

(58) Field of Classification Search
CPC ..... A63B 21/0602; A63B 21/4043; A63B 21/4035; A63B 2225/09
See application file for complete search history.

(56) References Cited

U.S. PATENT DOCUMENTS 3,231,270 A * 1/1966 Winer ..... A63B 21/0602 482/106
4,357,009 A 11/1982 Baker
4,854,576 A * 8/1989 McWain ..... A63B 21/0602 482/106
5,967,952 A 10/1999 Bronstein et al.
6,099,441 A * 8/2000 Bonnet ..... A63B 21/072 482/106
6,149,555 A 11/2000 Kinback
6,758,795 B2 7/2004 Barber
7,211,031 B1 5/2007 Soloviev
8,652,016 B2 * 2/2014 Grand ..... A63B 21/075 482/106
9,387,356 B2 * 7/2016 Jaidar ..... A63B 15/00
2017/0021221 A1 1/2017 Hannula
2019/0162566 A1 * 5/2019 Pau ..... G01F 1/0755

* cited by examiner

*Primary Examiner* — Megan Anderson
(74) *Attorney, Agent, or Firm* — J. T. Hollin, Attorney at Law P.C.

(57) ABSTRACT

The inventive concept presented is a fitness training system featuring a plurality of different-sized containers having a detachable, water-tight sealing cap by which each container may be filled with a determinable quantity of a liquid, constituting a specific volume. The volume of the inserted liquid equates to a weight in pounds, facilitating the use of each container for exercise and fitness training. In the preferred embodiment, the liquid utilized is ordinary tap water. In this manner, a user may choose from a selection of variously-dimensioned containers, and proceed to fill an appropriate volume of water for creating the desired weight of one or more containers. By use of a handle grip and a handle stabilizer attached to the exterior surface of each container, the user exercises and strengthens a particular muscle or grouping of muscles, including the associated stabilizer muscles.

4 Claims, 4 Drawing Sheets

PORTABLE AND ADJUSTABLY WEIGHTED CONTAINERS OF LIQUID FOR FITNESS TRAINING

CROSS-REFERENCES TO RELATED APPLICATIONS

Figure 1:
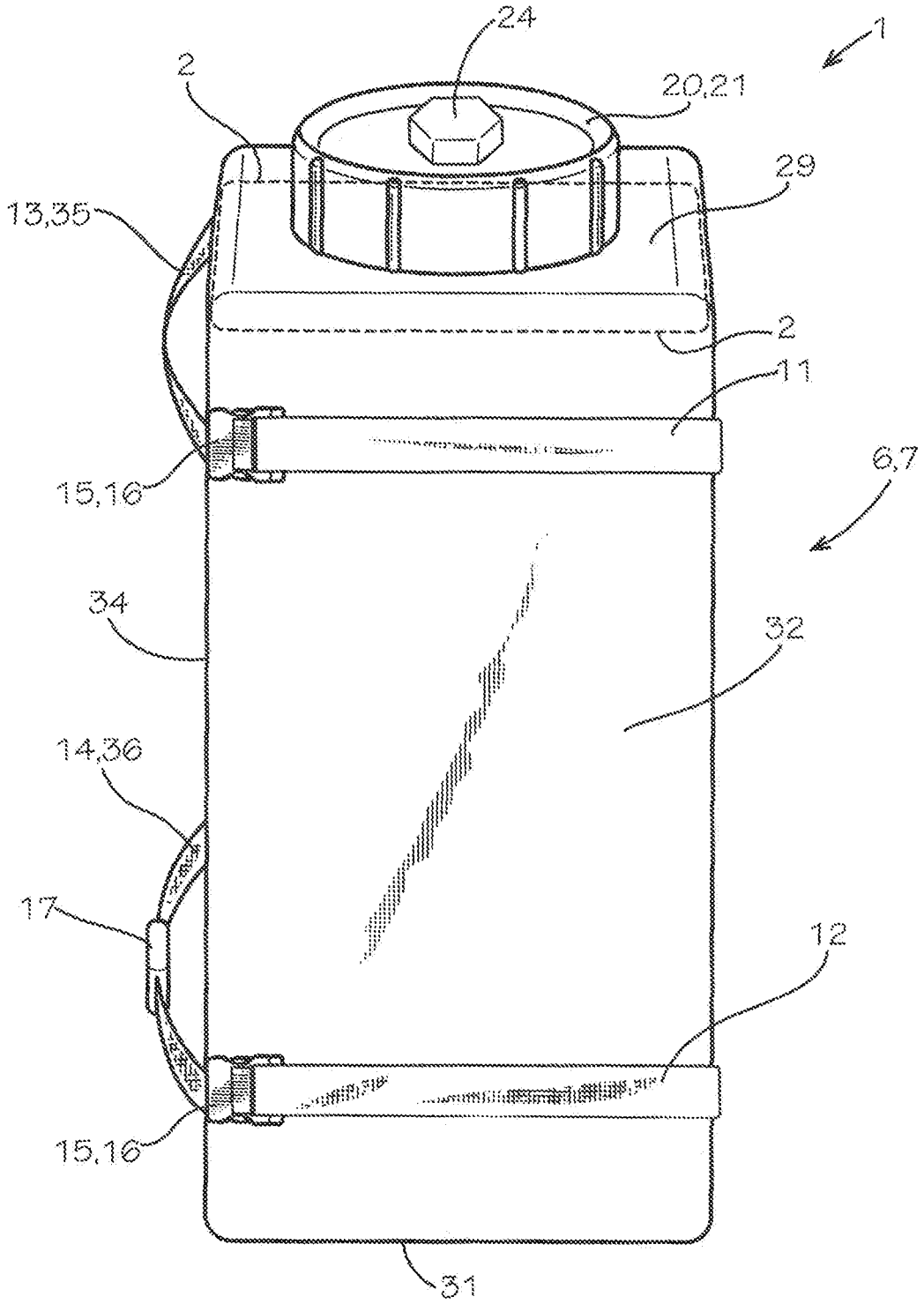

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION

(1) Field of the Invention

The field of the present inventive concept relates generally to methods and equipment utilized to accomplish weight and strength training. The system discloses "fillable" free weights comprising an assortment of hollow containers whose individual weights may be adjusted, from a maximum filled weight to an absolute minimum weight, the minimum being equal to the weight of the container itself. Correspondingly, when the container(s) are emptied, they may be compressed to a significantly smaller volume and lighter weight, making storage and/or transportation much more convenient.

(2) Description of the Related Art, Including Information Disclosed Under 37 CFR 1.97 and 1.98

The following documents contain information and material that, in certain circumstances, resembles the disclosures of the present inventive concept.

U.S. Pat. No. 4,357,009; Baker, P. (11-02-1982) A water-filled weight exercise bag having two compartments, one surrounding the lower leg and the other surrounding the foot, with a lace for retaining the bag in place, located under the foot and along the back of the leg. The adjustable lace allows the bag to be filled with differing weights of water to accommodate the particular weight required. The two compartments are connected by a portion for fluid communication there-between and which provide a hinge so that one of the compartments may be flexed out of the general plane of the other compartment.

U.S. Pat. No. 5,967,952; Bronstein, et al; (10-19-1999); A portable aquatic/land weight training system and method comprises a plurality of collapsible weight chamber members. Each of the collapsible weight chamber members includes a pair of flexible end members joined by first and second flexible band members forming a water- and air-tight chamber. The first band member forms an opening through the collapsible weight chamber member. The opening has a diameter D so as to pass a bar therethrough. Each weight chamber has a water valve and water valve closure member for filling the weight member with water and an air valve and air valve closure member for filling the weight chamber member with air. Each chamber is presized so that when completely filled with water it achieves a predetermined weight, i.e. 1, 2, 3, 5 lbs.

U.S. Pat. No. 6,149,555; Kinback, S. (11-21-2000); Disclosed is a variable weight exercise bag to be used by a person for weight lifting and physical fitness. The device includes a flexible main compartment with a resealable opening and convenient handles. The device is designed to hold weight bearing materials which provide the resistance required for physical exercise. The size, shape and materials of construction of the device make it suitable for a wide variety of aerobic and strength training exercises. When the device is empty it is very light and occupies minimal space.

U.S. Pat. No. 6,758,795 B2; Barber, S. (07-06-2004); A readily portable dumbell or barbell for exercising and weight training is provided in which weight units on an elongated handle comprise front and rear end plates interconnected by a collapsible/expandible fluid receptacle in the form of a resilient bellows. The weight unit is lengthened and expanded when fluid is added and is shortened and decreased in volume when fluid is removed. Calibration means are provided for visually indicating the weight of the unit corresponding to the longitudinal spacing between the front and end plates of the unit. In a preferred embodiment, a visually readable measurement of weight is provided by means for a graduated bar insert which extends slidably within the hollow handle of the dumbell or barbell and moves therealong with expansion or contraction of the water-filled bellows.

U.S. Pat. No. 7,211,031 B1; Soloviev, O. (05-01-2007); A portable exercise system for providing convenient weight training and exercise equipment. The portable exercise system includes a main housing assembly having at least one bladder member designed for being filled with water to provide weight; and a coupling assembly operationally coupled to the main housing assembly, the coupling assembly being designed for selectively securing the main housing assembly to a torso of a user.

U.S. Published Patent Application #2017/0021221 A1; Hannula, M. (01-26-2017); Disclosed is a versatile exercise apparatus which is portable and provides adjustable volume to weight ratio for multi-purpose weight, cardio, sport-specific, and martial arts training. Versatile exercise apparatus provides a user with the ability to adjust volume to weight ratio using a waterproof fillable cavity. The different markings on the transparent viewing window of the apparatus allow a user to vary the difficulty level of workouts by changing the corresponding weight of either water or sand added to the apparatus. Versatility is provided by the apparatus either being used as a backpack or a hand-held free weight, or a punching bag.

BRIEF SUMMARY OF THE INVENTION

The inventive concept presented is a fitness training system which features an assortment of different-sized containers, designated, for illustrative purposes only, from container size 6 to container size 10, each of which may be filled with variable quantities of a liquid. In the preferred embodiment, the liquid being water 2. In this manner, a user may choose from at least one of various containers 6-10, and proceed to fill the container with an appropriate volume of water 2 for creating a desired total weight of water 2 within the container. In that manner, the user may lift and maneuver the container to exercise a particular muscle or grouping of muscles.

All references to the term, "water" 2 in this disclosure are strictly for exemplary purposes. Further, the term water 2 will refer to readily available tap water which is obtainable in practically all residential, public, and commercial buildings and locations.

The disclosure, entitled "Liquid Weight Training System," is referred to in this document with the acronym, "LWTS" 1. The LWTS 1 provides a system of variably-sized containers, 6-10, each of which is fillable with water 2, and further, after filling, maneuverable such as to be lifted for anaerobic muscle resistance training by a user.

BRIEF DESCRIPTION OF THE VIEWS OF DRAWINGS AS EXEMPLARY EMBODIMENTS OF THE INVENTIVE CONCEPT

FIG. 1 illustrates the first container 6 (being of the same profile as the second container 7, resting on its bottom surface 31, the first container 6 being shown in its "full" state, with a maximum quantity of water 2.

Figure 2:
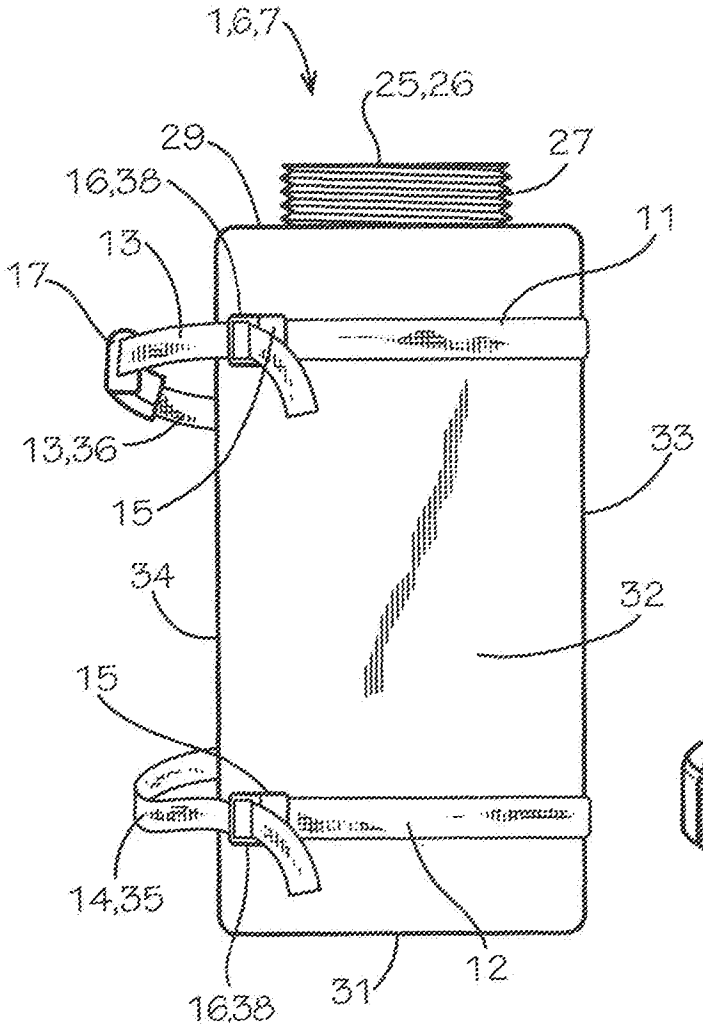

FIG. 2 shows the first container 6, further, being of a similar profile as the second container 7, with the first sealing cap 20 removed, further showing the exterior threads 27 on the rim 26 of the first container 6.

Figure 2A:
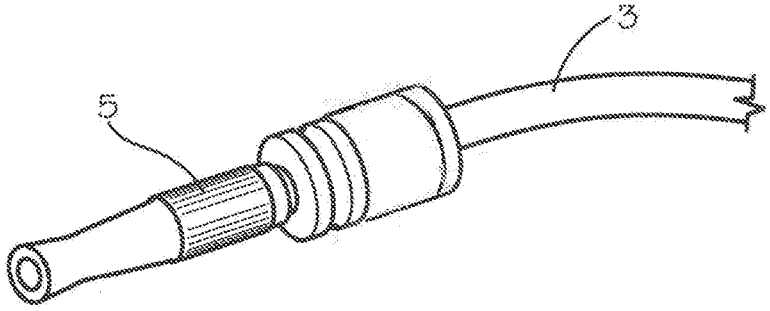

FIG. 2A depicts a hose 3, and nozzle 5 which may be utilized when filling any of the disclosed containers 6-10.

Figure 3:
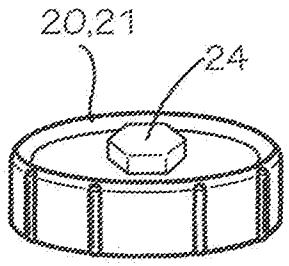

FIG. 3 depicts a representation of either the first sealing cap 20 or the second sealing cap 21, further showing a hexagonal nut integral to the surface of the sealing cap 20, 21.

Figure 4:
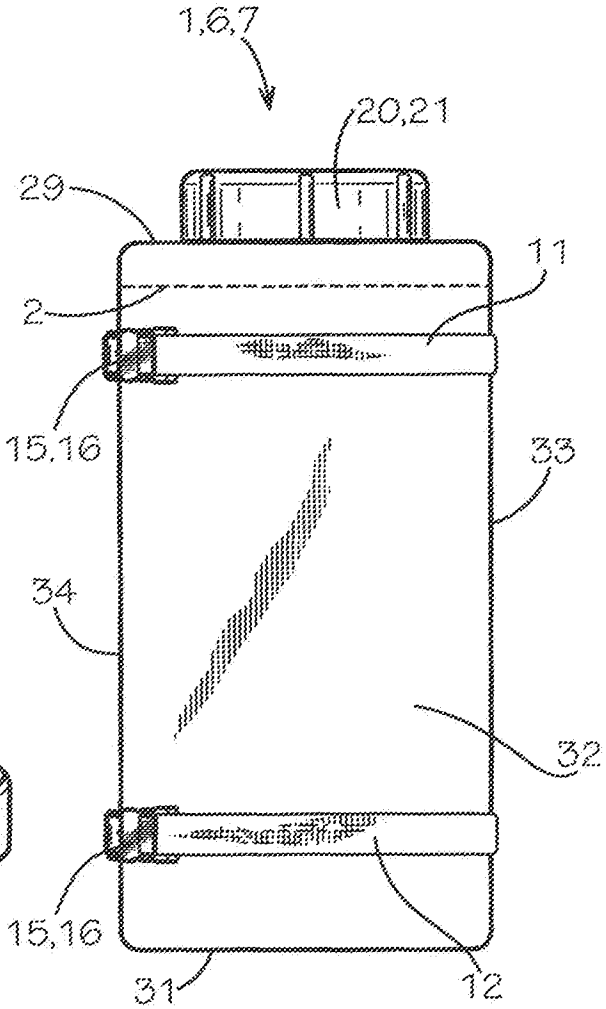

FIG. 4 presents a view of the first side 32 of the first (or second) container 6, 7 with the corresponding sealing cap 20, 21, having been screwed into place on the respective container 6, 7.

Figure 5:
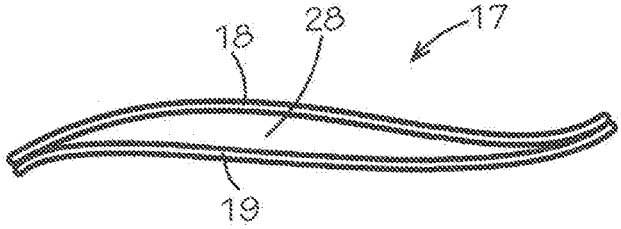

FIG. 5 illustrates the outer cover 18 and inner cover 19 of the pad 17, which may be placed about either of the free straps 13, 14 attachable to fixed straps 11, 12 about each of the containers 6-10 by which a user grasps to move and maneuver any of the containers 6-10.

Figure 6:
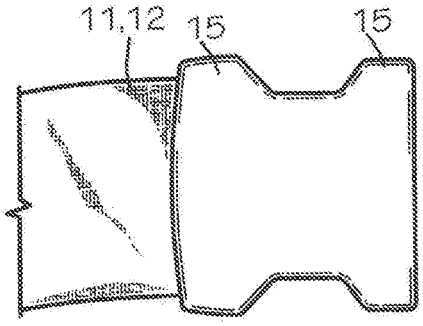

FIG. 6 is a representation of the preferred embodiment of a fastener, comprising a female connector 15, attached to both ends of the first and second fixed straps 11, 12.

Figure 6A:
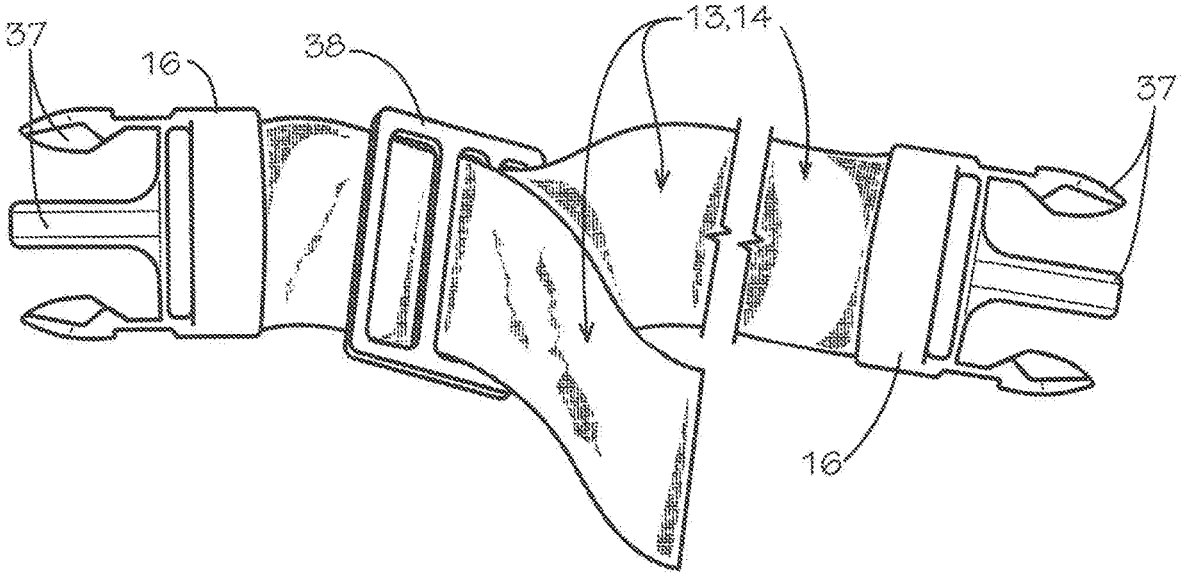

FIG. 6A is an embodiment of both the first free strap 13 and the second free strap 14, including the strap adjuster 38 integral to both free straps 13, 14.

Figure 7:
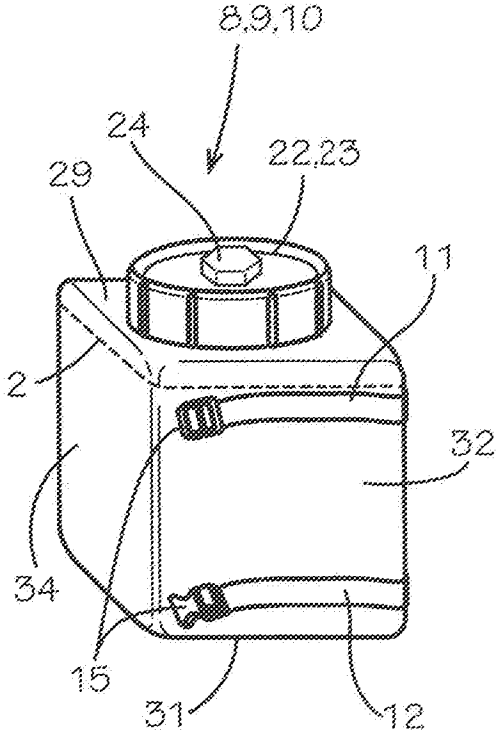

FIG. 7 shows the representative embodiment of a third container 8, a fourth container 9, or a fifth container 10 loaded with a full quantity of water 2, showing both a first fixed strap 11 and a second fixed strap 12, and further, a third sealing cap 22, and a fourth sealing cap 23 having been fastened in place.

Figure 8:
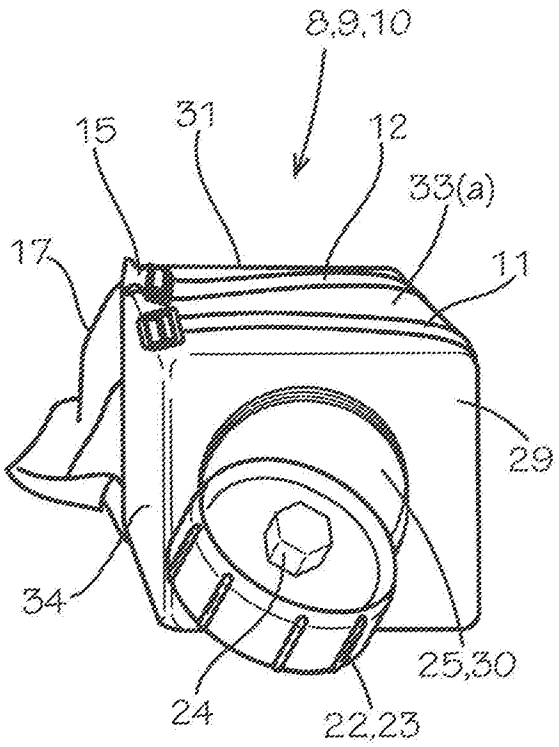

FIG. 8 presents a view of the third (or fourth) container 8/9 after it has been emptied of its fluid content, and further showing the interior 30 of the container 8/9 and its detached sealing cap 22, 23.

Figure 9:
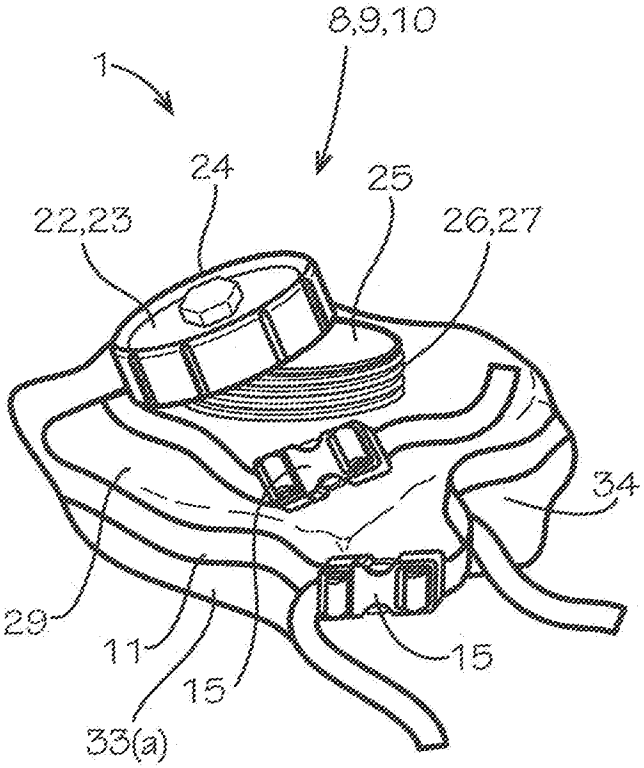

FIG. 9 demonstrates an empty third (or fourth) container 8/9, having been compressed into a compact configuration for storage and/or transportation.

| Table of Nomenclature & Part Numbers of Invention |
|---|
| 1. Liquid Weight Training System |
| 2. Water |
| 3. Hose |
| 4. N/A |

-continued

| Table of Nomenclature & Part Numbers of Invention |
|---|
| 5. Nozzle |
| 6. First container |
| 7. Second container |
| 8. Third container |
| 9. Fourth container |
| 10. Fifth container |
| 11. First fixed strap |
| 12. Second fixed strap |
| 13. First free strap |
| 14. Second free strap |
| 15. Female connector |
| 16. Male connector |
| 17. Pad |
| 18. Outer cover |
| 19. Inner cover |
| 20. First sealing cap |
| 21. Second sealing cap |
| 22. Third sealing cap |
| 23. Fourth sealing cap |
| 24. Hexagonal nut |
| 25. Aperture |
| 26. Rim |
| 27. Threads |
| 28. Opening |
| 29. Container top surface |
| 30. Container interior |
| 31. Container bottom surface |
| 32. First side |
| 33. Second side |
| 33(a) Third side |
| 34. Fourth side |
| 35. Handle grip |
| 36. Handle stabilizer |
| 37. Prong |
| 38. Strap adjuster |

DETAILED DESCRIPTION OF THE INVENTION

The LWTS 1 is a revolutionary concept having specific advantages, the primary objective being a method of enhancing the health and fitness of a user. Practically all free-weight training systems require a certain amount of floor space, stationary support mechanisms, rigid weights, and usually are limited in the manner in which the amount of weight used on a particular exercise device may be adjusted. Another objective is to provide effective training and strengthening of a person's stabilizer muscles.

This rigidness and inflexibility of most free-weight training systems have forced many fitness enthusiasts to compromise their workout consistency. However, consistency in weight training is a key factor of substantial and sustained development.

Another object of the LWTS 1 system is to provide an inherently simple method of packing the variously-sized weight containers 6-10, individually or collectively, for transportation and, as necessary, relatively easy storage. While many types of fitness equipment are suitable for working various muscle groups, LWTS 1 is a free-weight system that features one, or a plurality of, closeable containers, any of which a user fills with water 2 from any nearby water source. Therefore, a workout using the LWTS 1 system, may be accomplished almost anywhere the user travels and finds standing room to work out.

Typical locations would include a residence, the rear of a truck or cargo vehicle, a hotel room, or various types of commercial buildings. A user need only unpack one or more specific collapsed containers 6-10, un-do the sealing cap

20-23 which is a secure seal to the aperture of the container, then fill with the appropriate amount of water 2. The volume of water 2 corresponds to an amount of weight (10, 20, 30, 40, or higher amounts of pounds). The user then replaces the sealing cap 20-23 to close the corresponding opening of each weight container 6-10 that he/she intends to use, and begins the workout.

The objects, features, and advantages of the inventive concept presented in this application are more readily understood when referring to the accompanying drawings. The drawings, totaling nine figures, show the basic components and functions of embodiments and/or methods of use. In the several figures, like reference numbers are used in each figure to correspond to the same component as may be depicted in other figures.

The discussion of the present inventive concept will be initiated with FIG. 1, which illustrates an exemplary embodiment of a first container 6, which, for illustrative purposes only, exemplifies the largest-dimensioned of a system comprising a plurality of differently sized containers 6 through 10. For illustrative purposes only, five differently-sized containers will be discussed, from the largest size, being container 6, and decreasing in size proportionately from container 7 through container 10.

FIG. 1 illustrates the first container 6 resting on its bottom surface 31. The first container 6 is shown in the "full" state, having been filled with its maximum quantity of water 2. The first side 32 of the container is shown, typical of one of four sides of a rectangular cuboid, which is the preferred shape embodiment of each container 6-10. The first, second, third, and fourth sides, 32, 33, 33(*a*), 34 of all containers 6-10 must be of flexible elastic material which is easily inwardly compressible when the container 6-10 is empty. Further, all containers 6-10 must be of a waterproof material.

As an example of the weight bearing capacity of any of the containers 6-10, a reasonable maximum weight of water 2 to load into the first container 6 may be 60 pounds, which is equivalent to 7.202 gallons of water 2. This figure is arrived at, based on the density of room temperature water 2 being 8.33 pounds per gallon. Thus, the applicable formula is w=8.33 (g), where w equals the weight of water and g is the volume, in gallons.

There is not necessarily a restricted fixed weight or individual weight(s) that any container 6-10 may be limited to. Water, as the preferred liquid, is placed into the container, preferably by means of a common water hose 3 having a nozzle 5 connected to a spigot, and the opposite end of the hose 3 being placed into the aperture 25 (shown in FIG. 2A) of a container.

As an illustrative notation, the next smaller-dimensioned container, relative to container 6, entitled, a "second container" 7 may be fabricated so as to hold, in the preferred embodiment, an amount of water 2, in gallons, equivalent to 50 pounds. The structure and components of the second container 7 are also exemplified by FIG. 1, and for illustrative purposes only, shown as a rectangular polyhedral. The first and second containers 6, 7, may be of any geometric shape necessary to ensure comfort and ease of use during a desired fitness workout.

Correspondingly, a third container 8 may be sized and structured, for exemplary purposes only, to contain a volume of water 2 equivalent to 35 pounds; a fourth container 9 may be structured to contain a volume of water 2 equivalent to 25 pounds, while an embodiment of a fifth container 10 may be fabricated to contain 10 pounds of water 2 when filled to capacity.

Further depicted in FIG. 1 is the top surface 29 of the first (or second) container 6, 7, a first side 32, a first fixed strap 11, a second fixed strap 12, a handle grip 35, pad 17, and a handle stabilizer 36. Further shown is the first sealing cap 20, useable with the first container 6, and is also equivalent, in size and structure, to a second sealing cap 21 (for distinguishing purposes only) which is utilized with the second container 7. All embodiments of the sealing cap 20, 21, including the third sealing cap 22 and the fourth sealing cap 23, are constructed so as to be leak proof when engaged with the aperture 25 and threaded rim 26 of any container 6-10.

Straps and adjustable fastening mechanisms are used in conjunction with each container 6-10. The preferred embodiment of the adjustable fastening mechanism used on every size container 6-10 comprises a female connector 15 and a male connector 16, the male connector 16 having prongs 37 which are insertable into corresponding openings within the female connector 15. These connectors are more clearly understood by reference to FIG. 6. Other types and constructions of adjustable fastening mechanisms are also useable with the LWTS 1.

The preferred embodiment of the straps used in conjunction with the above-described adjustable fastening mechanisms comprises a first fixed strap 11 and a second fixed strap 12. The first and second fixed straps 11, 12 are symmetrically and permanently bonded to three of the outer surfaces of each particular container 6-10. Each end of the first fixed strap 11 and of the second fixed strap 12 has attached thereto, a female connector 15.

In FIG. 1, it is depicted that the first fixed strap 11 and the second fixed strap 12 are permanently bonded to the first side 32 of the container 6, 7, and further the bonding of the straps 11, 12 extends to the second side 33 and the third side 33(*a*)(not in view) of the container 6, 7. The first fixed strap 11 extends around the perimeter of its particular container 6-10, and both ends of the first fixed strap 11 terminate in a female connector 15. Likewise, the second fixed strap 12 of the same container 6-10 continues, bonded around the perimeter and transitions, at both ends, with a female connector 15 affixed thereto.

Again, referencing FIG. 1, a first free strap 13 is completely removable, and is not bonded to any surface of the first container 6 or the second container 7. Similarly, a second free strap 14 is completely removable, and is not bonded to any surface of the first container 6 or the second container 7. Each end of both the first and second free straps 13, 14 manifests a male connector 16 attached thereto. A clearer descriptive explanation of the free straps 13, 14, is shown in FIG. 6A.

By this arrangement, the female and male connectors 15, 16 are utilized to securely join the first fixed strap 11 with the continuation of the first free strap 13, and likewise, join the second fixed strap 12 with the second free strap 14. All containers 6-10 are constructed with the identical straps 11, 12, 13, 14 and attached connectors, 15, 16.

A user, prior to exercising with any of the containers 6, 7, 8, 9, 10 must first grasp, successively, each free strap 13, 14 and maneuver the fastening of both its male connectors 16 onto its corresponding fixed strap 11, 12. The resulting fastening configurations are joined together in close proximity to the fourth side 34 of each of the containers 6-10. This configuration renders the fourth side 34 the useable surface as the location where the pad 17 forming the handle stabilizer 36 and also the handle grip 35 are arranged. This placement necessarily requires some degree of container contact, balancing, and leverage against the fourth side 34 by the hands and gripping actions of a user.

Thus, the two adjustable fasteners 15, 16, allow a user to fasten the identical combinations of the first fixed strap 11 hooked to its first free strap 13, along with the second fixed strap 12 hooked to its second free strap 14. A pad 17, having a separable outer cover 18 and an inner cover 19 (as shown in FIG. 5) may be utilized for placement of either, or both, the first free strap 13 and/or the second free strap 14, into the opening formed by the outer surface 18 and the inner surface 19 of the pad 17.

When the pad 17 is used in conjunction with either the first free strap 13 and/or the second free strap 14, this combination functions in the capacity of a handle stabilizer 36. The handle stabilizer 36 thereby provides a cushioning protection for the hand of a user grasping it. If a user options to perform workouts without the cushioning of the pad 17, the user grasps the first free strap 13 and/or the second free strap 14 merely in the function of a handle grip 35.

As stated earlier, the female and male connectors 15, 16 are utilized to securely join the first and second fixed straps 11, 12 with their corresponding first free strap 13 and second free strap 14. This enables the adjustment of the tension or clearance of either the handle grip 35, and/or handle stabilizer 36 respectively, before or during a strength workout.

In viewing FIG. 2, there is illustrated a view of the first side 32 of either the first/second container 6, 7, having the first sealing cap 20 or second sealing cap 21 (shown in FIG. 3) removed. FIG. 2 further shows the rim 26, leading to an aperture 25, or mouth of the first/second container 6, 7. Additionally, in the embodiment shown in FIG. 2, the rim 26 is exteriorly threaded 27 so as to be compatible with female threading integral to the interior perimeter of the first sealing cap 20. The second sealing cap 21 is constructed in an identical manner as the first sealing cap 20. All sealing caps 20, 21, 22, 23, are constructed so as to form a watertight seal when joined to the respective rim 26 of any container 6-10.

FIG. 2 further depicts the first free strap 13 and second free strap 14 both of their male connectors 16 having been inserted into the respective female connectors 15. It should be noted that a pad 17 is used in conjunction with the first free strap 13, thereby providing the function of a handle stabilizer 36.

FIG. 3 shows a standalone view of a detached first sealing cap 20 or a second sealing cap 21, both having identical construction and dimensions, and both being compatible with the rim 26 of either container 6, 7.

FIG. 4 illustrates a typical embodiment of either a first container 6 or a second container 7, showing the sealing cap 20, 21 having been secured to the aperture 25 (shown in FIG. 2) at the top surface 29 of the first or second container 6, 7. The first/second, container 6, 7 demonstrates the configuration wherein a maximum tightening of the first free strap 13 (not shown) and second free strap 14 (not shown) against the third side 34 of the container 6, 7 has been accomplished.

Referring to FIG. 5, there is illustrated a side, or profile, view of the outer cover 18 and inner cover 19 of the pad 17. The pad 17 may be arranged by a user to place either the first free strap 13 and/or the second free strap 14, into the opening 28 formed by the outer surface 18 and the inner surface 19 of the pad 17. This, as a result, forms a handle stabilizer 36 which provides cushioning to the grasping palm and inner fingers of a user. The user may then readily grasp the handle stabilizer 36 and more effectively move and maneuver any of the containers 6-10. In some embodiments, a second pad 17 may also be utilized on the second free strap 14 to provide two handle stabilizers 36.

FIG. 6 is a view of the preferred embodiment of the fastener mechanism, comprising one end of either the first fixed strap 11 or the second fixed strap 12 attached to a female connector 15. Both ends of the first fixed strap 11 and the second fixed strap 12 are affixed to a female connector 15. Each end of the first and second free straps 13, 14 is connected to a male fastener 16. FIG. 6A is an embodiment of both the first strap 13 and the second free strap 14, including the strap adjuster 38 used to adjust the amount of spacing between a free strap 13, 14 and the exterior surface of the fourth side 34 of any selected container 6-10.

FIG. 7, FIG. 8, and FIG. 9, for exemplary purposes only, show a representative embodiment of either the third container 8, the fourth container 9, or the fifth container 10, each of which, in ascending numerical designation, is constructed as a progressively smaller-dimensioned container 8, 9, 10. Specifically, FIG. 7 presents a view of a container 8, 9, 10, loaded with a full quantity of water 2, showing both the first fixed strap 11 and the second fixed strap 12, and further, the sealing cap 22, 23 having been fastened in place.

FIG. 8 presents a typical view of either the third, fourth, or fifth container 8, 9 or 10, after it has been emptied of its fluid content and allowed to rest on its first side 32 (not in view). Further shown is either the third sealing cap 22, or fourth sealing cap 24 both of which are compatible with the smaller containers 8, 9, 10. FIG. 9 illustrates that the third, fourth, or fifth container 8, 9, 10 may be compressed into a compact configuration for ease of transport and storage.

Once the user finishes their workout, he/she can easily and quickly individually unseal whichever of the container(s) 8, 9, 10 was used, pour the water 2 out, dry the interior of each container 6-10, then compress and store the containers 6-10 in a convenient location until the next workout. When initiating a workout, a user should choose at least one container(s) 6-10 which has the volumetric dimensions equivalent, when filled with water 2, to the desired weight needed for the workout envisioned. The user selects the time and place that is suitable for accomplishing the workout.

An important objective of the present inventive concept is that the LWTS 1 be designed and constructed to keep a person's body engaged by also incorporating the body's "stabilizer" muscles.

The stabilizer muscles are an important aspect of fitness training and athletic performance. Fitness enthusiasts attempt to keep their workouts varied and adding extra elements of instability. Working out with a Swiss Ball accomplishes this, or also performing one-handed or one-legged exercises. Another example is where executing the identical exercise with a dumbbell in each hand, a user is forced to incorporate several smaller, non-primary muscles in his/her chest and arms to keep the exercise functioning, without becoming unbalanced and possibly falling forward, backwards, or to the side.

Athletes rarely move their bodies in just a single plane. While performing an activity, they are continuously bending, turning, pushing, pulling, stopping, starting, and/or jumping at various angles, speeds and directions. To do those movements efficiently and injury-free, the athletes' stabilizer muscles must function correctly. This is where the LWTS system is effective, in that the handle grip 35, used in conjunction with the handle stabilizer 36, forces a user to exercise in a manner that incorporates stabilizer muscles. The relative positioning of the handle grip 35 and the handle stabilizer 36 are depicted in FIG. 1 (container 1) and FIG. 2 (container 6 or 7), and is typical of all containers 6-10 of the LWTS 1.

While preferred embodiments of the present inventive method have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, as described by the scope of the claims presented herein.

What is claimed is:

1. At least one container of liquid, the at least one container used for the purpose of lifting and maneuvering the at least one container so as to strengthen and exercise any one of a selected primary muscle of human anatomy, while simultaneously strengthening and exercising stabilizer muscle or muscles associated with the said primary muscle, comprising:

a) a closeable aperture;

b) a means for securely closing the aperture;

c) internal dimensions which, when the at least one container is filled with the liquid, the volume of the liquid equates to a specific whole number of pounds;

d) a flexible material forming outer and inner surfaces allowing the at least one container, when emptied, to be compressed to a smaller shape;

e) a first fixed strap and a second fixed strap, both of said first and second fixed strap bonded, in a parallel orientation, to three-fourths of the exterior perimeter of the container;

f) a female connector, being a component of a male-female fastening mechanism attached to each end of the first fixed strap and an identical female connector attached to each end of the second fixed strap;

g) a first free strap and a second free strap, wherein, both the first free strap and the second free strap are set apart and autonomous from, the at least one container;

h) a male connector corresponding to the female connector of the aforesaid male-female fastening mechanism being attached to each end of the first free strap;

i) a male connector corresponding to the female connector of the aforesaid male-female fastening mechanism being attached to each end of the second free strap;

and j) a pad; wherein the pad is configured to be placed on either the first free strap or the second free strap to function together as a handle stabilizer, while the other of the first free strap or the second free strap functions as a handle grip.

2. The at least one container of liquid of claim 1, wherein the outer and inner surfaces and the exterior perimeter of the at least one container are constructed with a material having an elastic quality enabling the inward compression of the entirety of the at least one container when it is empty of the liquid.

3. A method for utilization of portable, conveniently storable weight containers for strengthening and exercising a person's muscles while simultaneously exercising and strengthening the person's stabilizer muscles, the method comprising:

a) providing at least one container having inner and outer surfaces which are flexible and compressible;

b) providing a closeable aperture through which water is inserted into the at least one container, the volume of water equating to a specific weight in pounds;

c) providing a first fixed strap and a second fixed strap, both of said first and second fixed straps bonded, in a parallel orientation, to three-fourths of the exterior perimeter of the at least one container;

d) providing two female connectors of a male-female fastening mechanism for attachment, one to each end of the first fixed strap and providing two identical female connectors for attachment, one to each end of the second fixed strap;

e) providing a first free strap and a second free strap, wherein a male connector corresponding to the female connector of the aforesaid male-female fastening mechanism is attached, one to each end of the first free strap and two identical male connectors are attached, one to each end of the second free strap; and f) providing a pad, wherein the pad is configured to be placed on either the first free strap or the second free strap to function together as a handle stabilizer, while the other of the first free strap or the second free strap functions as a handle grip; wherein the at least one container is hoisted and maneuvered by the handle grip and the handle stabilizer; and g) opening the closeable aperture, emptying the water content of the at least one container, and compressing the container into a smaller configuration.

4. The method of claim 3, further providing for the at least one container being constructed with inner and outer surfaces of an elastic quality enabling inward compression of the entirety of each side of the at least one container when it is empty of the liquid.

* * * * *